United States Patent [19]

Åsman

[11] 4,188,917

[45] Feb. 19, 1980

[54] METHOD AND DEVICE FOR IMPROVING THE EFFICIENCY OF HEAT GENERATORS

[76] Inventor: Elof V. Åsman, Terrassvägen 4 A, 891 00 Örnsköldsvik, Sweden

[21] Appl. No.: 897,827

[22] Filed: Apr. 19, 1978

[30] Foreign Application Priority Data

Apr. 28, 1977 [SE] Sweden ..... 7704942

[51] Int. Cl.[2] ..... F22B 11/04

[52] U.S. Cl. ..... 122/134; 122/136 C

[58] Field of Search ..... 122/134, 136 R, 136 C

[56] References Cited

U.S. PATENT DOCUMENTS

| | | | |
|---|---|---|---|
| 26,788 | 1/1860 | Schaubel | 122/134 |
| 2,651,294 | 9/1953 | Horne | 122/134 |
| 2,787,318 | 4/1957 | Wolfersperger | 122/134 |

FOREIGN PATENT DOCUMENTS

| | | | |
|---|---|---|---|
| 432034 | 7/1926 | Fed. Rep. of Germany | 122/134 |

*Primary Examiner*—Edward G. Favors

*Attorney, Agent, or Firm*—Dowell & Dowell

[57] ABSTRACT

An apparatus for heating a first fluid such as water or the like by moving such fluid in counterflow heat exchange relationship with a heated second fluid such as air. A spiral wall is provided in a portion of the apparatus which defines a spiral passageway for the heated fluid and such wall includes at least one conduit for the fluid to be heated. A removable wall normally closes one end of the heated area and the spiral wall to provide access thereto when the wall is removed.

7 Claims, 4 Drawing Figures

METHOD AND DEVICE FOR IMPROVING THE EFFICIENCY OF HEAT GENERATORS

The present invention relates to a method of improving the efficiency of heat generators, e.g. boilers, etc., whereby one medium, e.g. a combustion or flue gas is made to transfer its heat to another medium which is then heated so that although both media flow independent of each other heat is transferred between them. The invention also relates to a device for the execution of the method.

Heat from generators used for heating or steam-producing purposes such as boilers, furnaces, etc., is transferred from the combustion of solid or liquid fuels via combustion gases to another medium, e.g. water. Although it is possible to use other media than water for this purpose, the following description refers to the transfer of heat to water and covers all other possible media, particularly mixtures of water and other substances, e.g. water and anti-freeze and/or anti-rust agents, etc.

As is known the majority of the combustion heat is transferred to the boiler—and via this to the medium to be heated—during the longitudinal and transverse flow of the gases over the exchange surfaces of the boiler. In known heat generators of the above type, the combustion chamber is either totally or partially enclosed by a water-filled cavity formed by a jacket and/or pipes and tubes or a combination of the two. Heat generators are often oblong and to improve the transfer of heat the combustion chamber where the combustion gases are formed is positioned in the centre of the heat generator and the gases flow along the oblong chamber to and end wall where they are reversed and then flow back again outside the central gas flow. This causes the return gases to come into contact with the walls of the water-filled cavity and transfer heat to the water inside. To further increase the exchange of heat the combustion gases can also be led in a counter direction through tubes, pipes, etc., positioned in the water-filled cavity thereby transferring additional heat to the water before being discharged into the atmosphere. The combustion gases can also be routed through a labyrinth structure between the boiler walls which is connected to the pipes and which forms heat exchange baffles for them.

However the recognized method of using a multiple re-routing of the combustion gases to achieve the transfer of heat between the combustion gases and the medium to be heated has several disadvantages. The speed of the gas flow is negatively affected by the number of changes in the direction of flow of the combustion gases in the combustion chamber. The counter flow of the gases in the combustion chamber could even reduce the effective heat transfer because the central current of gas in the combustion chamber, which is the hotest, becomes surrounded by gases flowing backwards from the end wall where they have already been cooled, thereby forming a layer of cool gas between the hot central gas current and the water jacket. As the transfer of heat increases the faster the gases flow through the boiler and the greater the resistance afforded by the boiler to the current of gases, several attempts have been made to increase the speed of the gas flow and the resistance to it. Measures taken include various designs of the pipes or tubes through which the gases flow. Another method of increasing the heat transfer is to provide a secondary radiation surface, e.g. a sheet metal insert in the pipes of tubes. However it has not been possible to achieve any noticeable improvement in efficiency using these measures. One disadvantage of the known measures is that the boiler and particularly the tubes can become blocked by soot if efficient soot-removal methods are not employed, and this has the opposite effect of substantially lowering the efficiency of the boiler. There exists, therefore, a real need to improve the efficiency of heat generators of the type stated above using other means so bettering heating economy and enabling substantial energy savings to be made.

The primary purpose of the present invention is therefore to provide a method and device to improve the efficiency of heat generators of the type mentioned earlier so that their efficiency is substantially increased.

This invention realizes this aim by a method which is characterized by one medium, e.g. the gas, being introduced in the centre and extracted at the periphery of a spiral, a method which in itself is already known, along which the other medium is also made to flow, whereby a mechanically-induced vortex motion is imparted to the gas thereby improving combustion efficiency and increasing the speed of the gas flow.

In addition to the improvement in combustion efficiency the invention also allows for the utilization of the improved heat transfer which is associated with normal spiral coil heat exchangers of this type, shown e.g. in the Swedish patents 183.405 and 198.092 which are based on the media flowing in spiral paths.

The invention is described in more detail below with reference to the attached drawings which show an embodiment of a device for the execution of the method.

Figure 1:
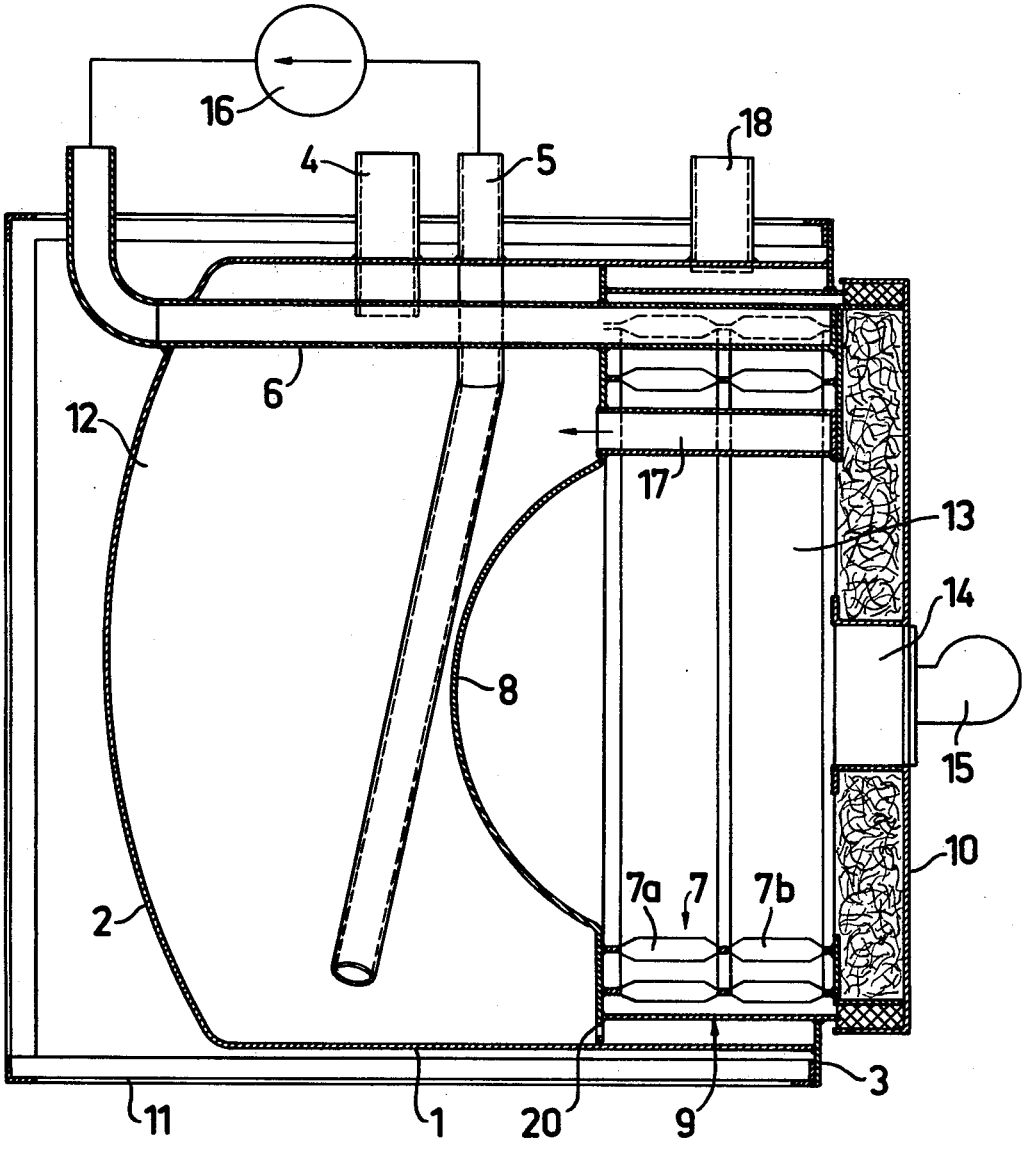
FIG. 1 is a section through the length of a boiler designed according to the invention, the cross section following line I—I in FIG. 2.

The boiler shown in FIG. 1 consists of a cylindrical chamber 1 with a domed end plate 2 at one end while the other end, some distance from the end of the chamber 1, supports an intermediate plate 8 which divides the cylinder 1 into two chambers. The chamber 12 contained by the cylinder 1 and the plates 2 and 8 forms a water storage tank, while the other chamber in the cylinder 1 houses the combustion chamber and the water jacket. The combustion chamber 13 is positioned centrally in the cylinder 1 and is enclosed by a water jacket designated 7. The combustion chamber 13 and the water jacket 7 terminate at the end of the cylinder 1 in an insulated wall 10 which can also be made to open so forming an opening affording access to the boiler's internal combustion chamber and water jacket. The wall 10 is provided with a central aperture 14 intended to be used to insert a conventional oil burner which generates the necessary combustion gases. The oil burner, which is diagrammatically designated 15, generates flame in the known manner, which is preferably directed at right angles to the end wall 8 inside the combustion chamber 13.

Water is removed from the storage tank 12 via a pipe 5 and is pumped by a pump 16 to a pipe 6 which runs to the uppermost end of the water jacket 7 which is connected for water transfer purposes to the pipe 6. The pipe 6 therefore constitutes a feed pipe for one or more conduits in the water jacket 7, which are represented in the diagram by two conduits *7a* and *7b*. These two conduits *7a* and *7b* are separated from each other by a partitioning section so that no liquid can be transferred between them. The number of conduits can be varied within wide limits, as will be explained below.

Figure 2:
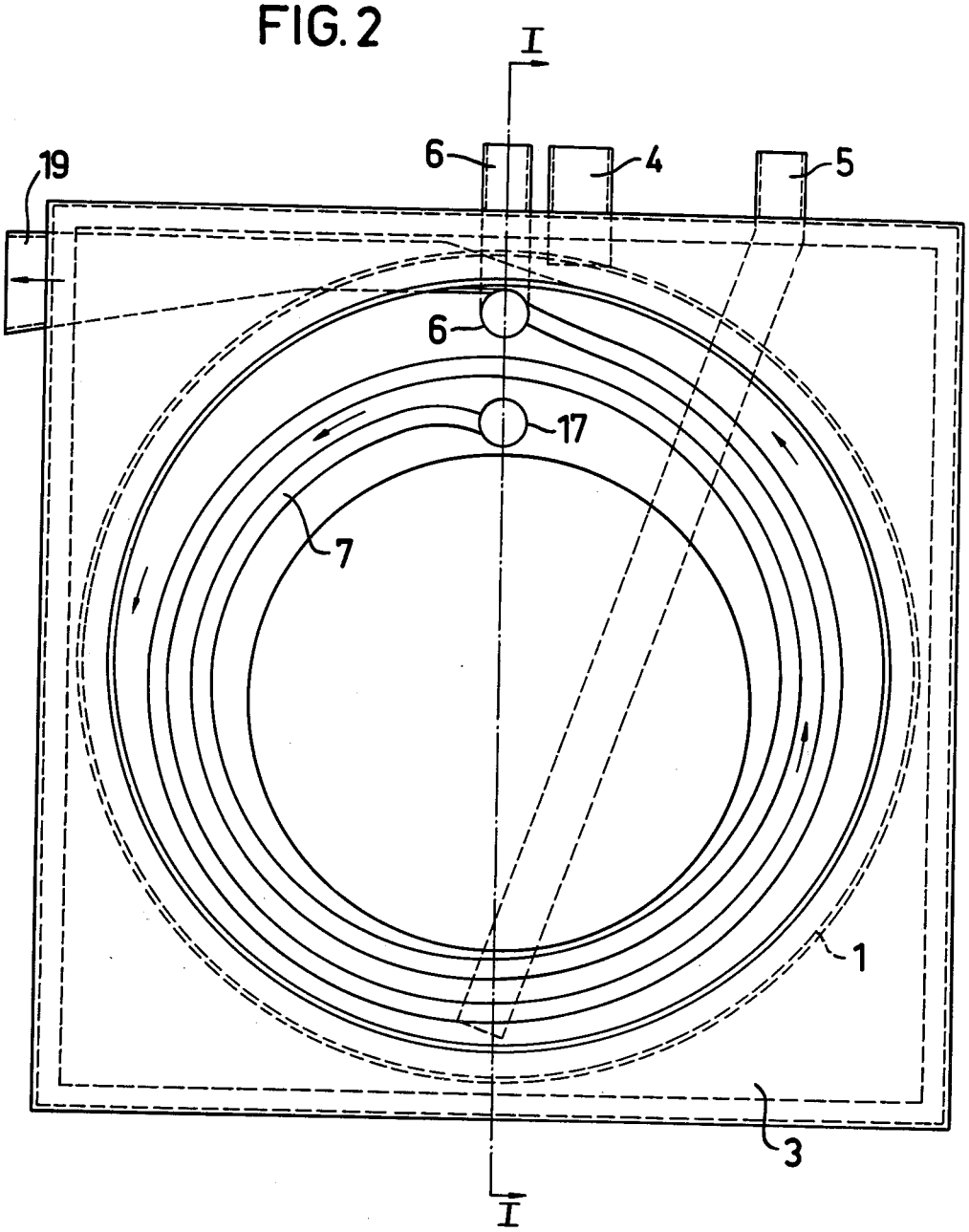
FIG. 2 is a side view of the boiler shown in FIG. 1 with the end plate removed.

As can be seen from FIG. 2, according to the invention the water jacket 7 is in the form of a spiral, there being a passageway of sufficient space between the coils of the spiral to allow the combustion gases to flow from the centre of the boiler to the outer periphery. At the inner section the water jacket's conduits *7a* and *7b* are connected to a common pipe 17 which returns the water that has passed through the jacket 7 to the storage tank 12. A pipe 4 discharges from the top of the tank 12 for removal of water to the network, e.g. for heating, hot water pipes, etc. The return water from the network is fed back via a pipe 18 to a jacket 9 which has a space between it and the water jacket 7. The inside of the jacket 9, as can be seen in FIG. 2, comes into contact with the flue gases prior to them leaving the boiler through the flue gas duct 19 (shown in FIG. 2). From the water jacket 9 the water passes back to the storage tank 12 via apertures 20 in the end wall 8. The boiler is mounted on a frame 11 via an end wall 3 which is attached to the right-hand end of the cylinder 1 in FIG. 1.

As described above, the combustion gases from the oil burner's 15 flame are made to flow outwards into the space between the coils of the spiral water jacket 7, as indicated by the arrows in FIG. 2. Once the gases have passed through all the coils of the water jacket 7 they flow between the outer surface of the jacket 7 and the inner surface of the jacket 9 for the incoming return water from the network thereby heating the water before it is returned to the storage tank 12. The flue gases finally leave the boiler through the flue gas duct 19. In this way the gases are mechanically guided into a path in which the speed of the gas flow is increased by the gas induced into a vortex motion. When the gas is forced outwards by the vortex motion the pressure of the gas against the surfaces of the water jacket 7 also increases which aids the transfer of heat between the combustion gases and the exchange surface.

As is known the principal resistance to heat transfer always lies essentially between the gases and the exchange surface. This resistance is considerably reduced by increasing the speed of the gas flow and increasing the pressure of the gas against the exchange surface—a result of the effect of the centrifugal force generated by the vortex motion of the gas. The distance between the coils or windings of the water jacket 7 should therefore be the smallest possible with consideration to the speed of the flue gas flow so that the greatest possible improvement in efficiency is obtained. The water jacket 7 which contains several conduits *7a, 7b* (two conduits in the example shown) are separated from each other and should preferably be made of rust-proof or acid-resistant material. However, a simpler material can be used if desired without the benefits described being diminished. As can be seen from the description of the arrangement of the inlet and outlet pipes 6 and 17, the water in the conduits of the jacket 7 flows counter to the flow of the combustion gases which also considerably improves efficiency.

Figure 3:
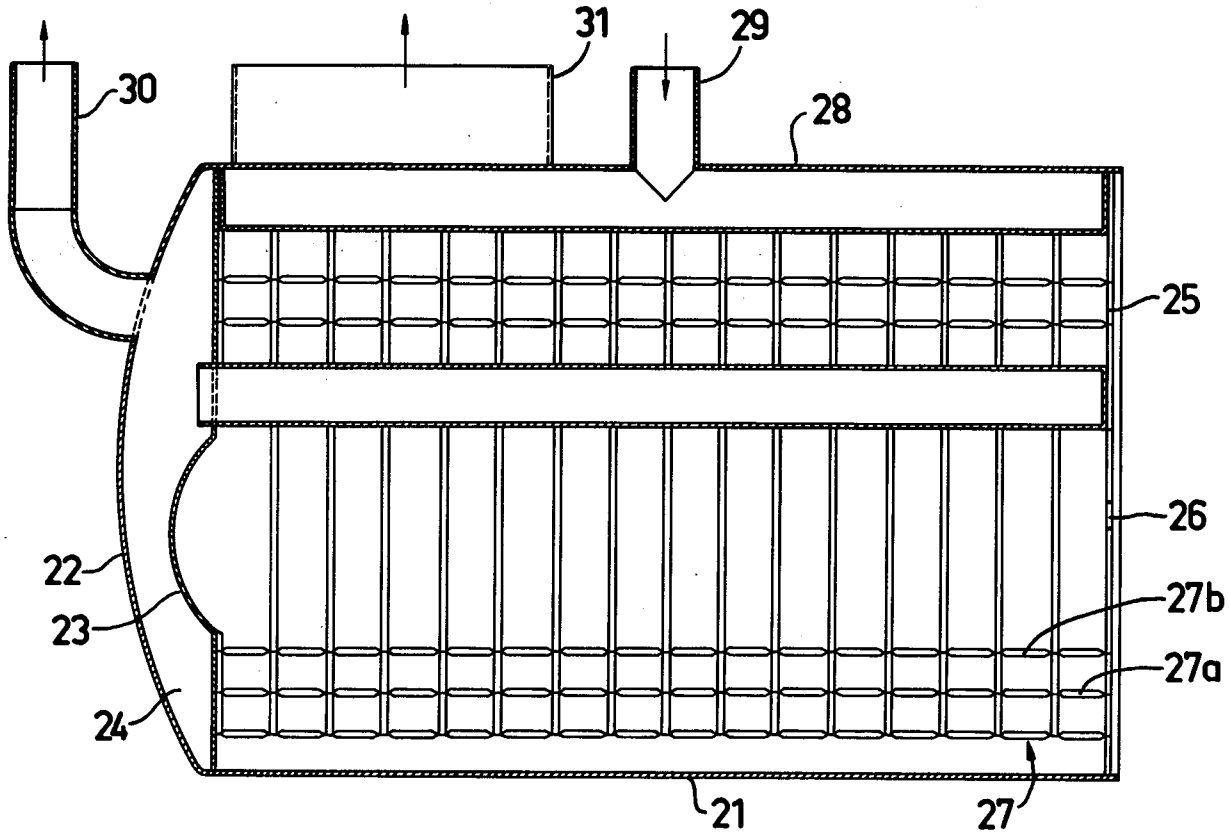
FIG. 3 is a section through the length of an altered embodiment design.

FIG. 3 shows a further embodiment of the device according to the invention in which the boiler consists of a cylinder 21 which at its left-hand end terminates in one of the end walls 22, 23 enclosing the chamber 24 and at its right-hand end in an end wall 25 with an opening 26 for an oil burner or similar heating device. It is therefore clear that the end wall 25 can be covered by an insulated wall or be provided with an aperture of the same type as the wall 10 in the boiler shown in FIG. 1, although this is not shown in FIG. 3. The water jacket 27 in the embodiment design shown in FIG. 3 consists of several separate conduits *27a, 27b,* etc., running along the length of the boiler. In the embodiment design shown there are sixteen such conduits which are wound into a spiral in the same way as for the boiler shown in FIGS. 1 and 2. The outer ends of all the conduits in the jacket 27 are connected to a common inlet pipe 28 which has an inlet 29 for connection to the return water from the system, while the heated water is led via the chamber 24 at the left-hand end of the boiler to the system through a connecting pipe 30. The flue gases leave the boiler through a flue gas duct 31. These combustion gases and the water also flow counter to each other in FIG. 3. It can be seen from FIG. 3 that the design of the flue gas ducts aided by the water jacket designed according to the invention, resulting in the gas adopting a vortex motion, can also be used in large boilers. Consequently any width of water jacket, and thereby the number of separate conduits, can be used without deviating from the principles of the invention.

Figure 4:
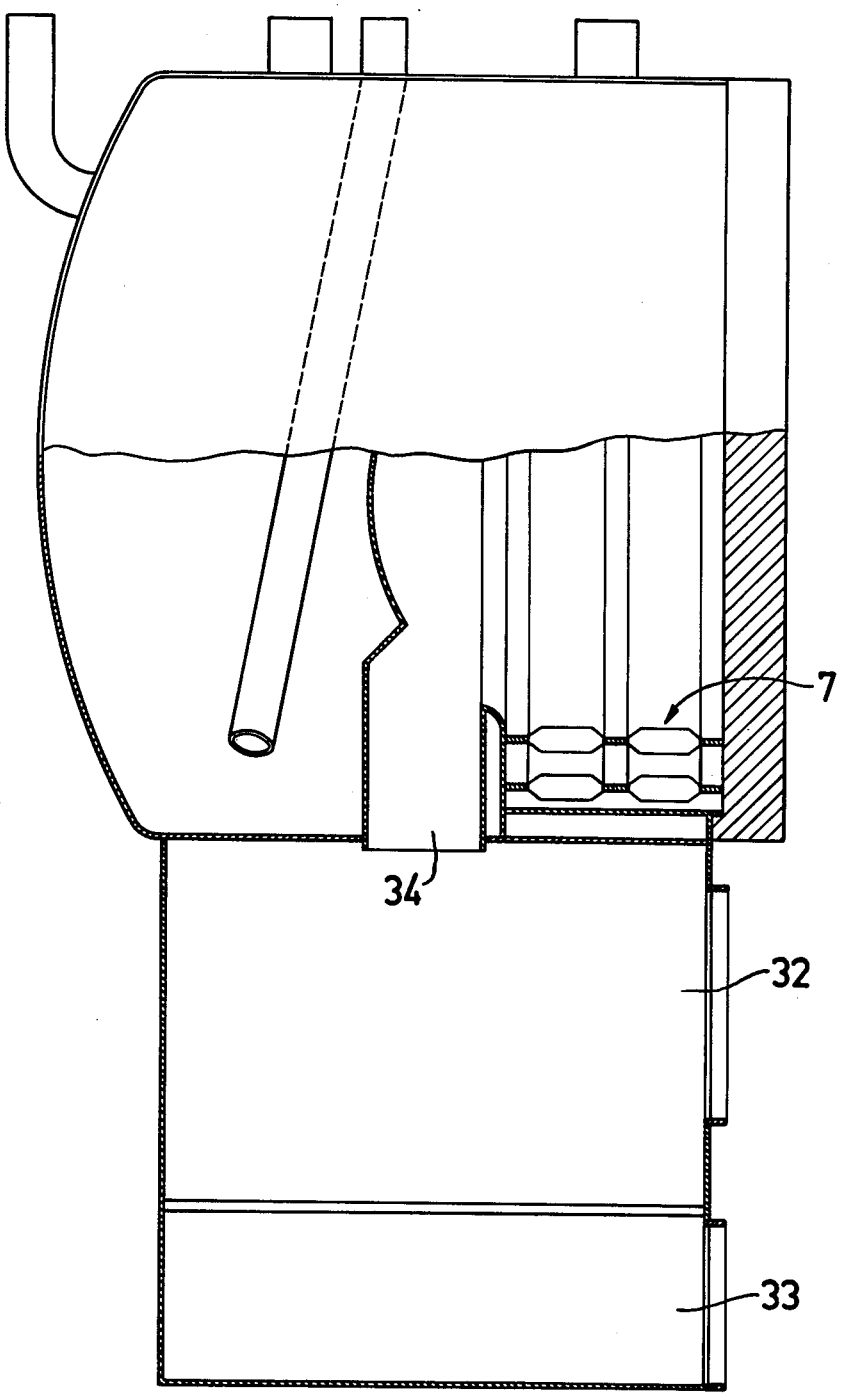
FIG. 4 is a section similar to that in FIG. 1 of yet another altered embodiment design.

In the embodiment shown in FIG. 4 the boiler has been designed in the same way as in FIG. 1 but instead of an oil burner it has been equipped with a grate or fire-box 32 for solid firing. A similar box 33 for collecting ash and the suchlike has therefore been positioned under the fire-box. The combustion gases flow upwards from the fire-box through the connecting duct 34 between the fire-box and the interior of the boiler and are discharged through the flue gas duct enclosed by the water jacket 7 in the same way as described for FIG. 1.

As can be gathered from the above, the invention improves the efficiency of heat generators by mechanically placing the gases in a path in such a way that they adopt a vortex motion thereby increasing the speed of the gas flow. By thereby causing the combustion gases and the water circulation to flow counter to each other an additional improvement of efficiency is obtained, which in experiments has reached 20–40%. With efficient combustion and the relatively high speed of the gas flow inside the boiler's flue gas ducts, which are preferably made of smooth, stainless surfaces, there is practically speaking no soot formation in the boiler when the burner is correctly adjusted. The boiler is easily cleaned of soot as all the flue gas ducts are exposed when the front wall 10 is opened. Even the flue gas duct 19 can be arranged so that it is easily accessible when the wall 10 is opened. A further benefit obtained is that because the boiler does not have any large open volumes all amplification of noise from the burner flames is eliminated, the noise being muffled with a very low level of sound resulting. This is also due to the sound from the flames being forced to pass through several steel walls separated from each other by fast-flowing water. The substantial increase in efficiency allows the boiler's dimensions and weight to be considerably reduced while retaining the same power output. Thanks to the high efficiency the volume of water in the boiler can can also be kept low and can even be used without a storage tank as the heating capacity is reached shortly after start-up. Naturally the boiler can also be connected to an independent water storage tank of any size desired.

It is clear that the embodiments shown are only examples of the realization of the invention and it can be altered and varied within the framework of the following claims.

I claim:

1. An apparatus for heating a first fluid by moving said first fluid in heat exchange relationship with a heated second fluid comprising boiler means having a first chamber for receiving said first fluid and a second chamber for receiving said second fluid, an imperforate spiral wall defining a heating area and a spiral passageway within said second chamber, means for heating said second fluid within said heating area and moving said heated second fluid along said passageway in a first direction, said spiral wall including at least one conduit having an inlet and an outlet communicating with said first chamber, pump means for pumping fluid from said first chamber through said conduit in a direction opposite to the direction of movement of said heated second fluid, said heating area and said spiral passageway normally being closed by an end wall which is selectively removable to expose said heating area and said spiral passageway.

2. The invention of claim 1 in which said heating area is a combustion chamber.

3. The invention of claim 2 in which said heating means includes burner means mounted on said end wall.

4. The invention of claim 1 in which said heating means includes fire box means connected by a duct to said second chamber.

5. The invention of claim 1 including a jacket disposed around and spaced from said second chamber, said first chamber having an outlet pipe communicating with a network for supplying said heated first fluid thereto, said jacket having an inlet pipe communicating with the network for receiving said first fluid therefrom, the fluid in said space between said jacket and said second chamber being in heat exchange relationship with said second chamber, and means for discharging said first fluid from said space to said first chamber.

6. The invention of claim 1 in which said spiral wall includes a plurality of spaced conduits, each of said conduits including an inlet end communicating with a common inlet pipe, and each of said conduits including an outlet end communicating with a common outlet pipe.

7. The invention of claim 1 in which a portion of said first chamber is in heat exchange relationship with a portion of said heating area.

* * * * *